United States Patent [19]

Norman

[11] Patent Number: 4,461,087

[45] Date of Patent: Jul. 24, 1984

[54] FOLDABLE PEEP SIGHT

[76] Inventor: Ray Norman, R.R. 2, Box 135, Hibbing, Minn. 55746

[21] Appl. No.: 395,934

[22] Filed: Jul. 7, 1982

[51] Int. Cl.[3] ..... F41G 1/38

[52] U.S. Cl. ..... 33/249; 33/253; 33/261; 42/1 S

[58] Field of Search ..... 33/249, 253, 261, 245, 33/246, 247, 248; 42/1 S

[56] References Cited

U.S. PATENT DOCUMENTS

| | | | |
|---|---|---|---|
| 2,529,801 | 11/1950 | Fisk | 33/249 |
| 2,710,453 | 6/1955 | Beverly | 33/249 |
| 3,178,823 | 4/1965 | Lipski | 33/249 |
| 3,732,642 | 5/1973 | Bray | 33/249 X |

*Primary Examiner*—William D. Martin, Jr.
*Attorney, Agent, or Firm*—Wicks & Nemer

[57] ABSTRACT

A foldable peep sight according to the teachings of the present invention is shown for use with a firearm such as a rifle. A peep sighting member is mounted on an arm. The arm is pivotally mounted about a horizontal axis which is generally parallel to but spaced from the gun barrel by an arcuately shaped mount. The arm is pivotal between a first, non-sighting, transport, storage position adjacent the gun barrel and a second, sighting position spaced from the gun barrel and in firing alignment with the front sight of the firearm to allow aiming of the firearm by aligning the firearm to have the peep sight and the front sight of the firearm in line with the target. A spring located between a spring block attached to the mount and a leg attached to the arm biases the arm to its second, sighting position. The peep sighting member can be aligned by elongated slots through which screws extend for mounting the peep sighting member on the arm and by an abutment member which controls the angle the arm moves into its second, sighting position. In the preferred embodiment, the firearm further includes a pivotally mounted scope sight which is pivotal from a first, sighting position and a second, non-sighting position. When the scope sight is in its first, sighting position, the scope sight abuts with and moves the arm to its first, non-sighting position and when the scope sight is located in its second, non-sighting position, the scope sight does not abut with the arm of the foldable peep sight which then moves under the bias of the spring to its second, sighting position.

12 Claims, 5 Drawing Figures

FOLDABLE PEEP SIGHT

BACKGROUND AND SUMMARY

The present invention relates generally to firearms, more particularly to improved firearms, and specifically to a novel foldable peep sight for a firearm.

With the increasing use and popularity of long-range firearms such as rifles, the use and popularity of scope sights have likewise increased. However, under certain conditions, it is desirable to utilize peep-type sights rather than scope sights. However, the mounting of scope sights often prevent the use of peep sights unless the scope sight is physically removed. Therefore, a need has arisen for a peep sight which can be utilized in conjunction with a scope sight without requiring the removal of the scope sight and allowing immediate use of either the peep sight or the scope sight in the field.

The present invention solves this need and other problems by providing a foldable peep sight according to the teachings of the present invention for its preferred use with a firearm. The peep sight includes an arm which is pivotally mounted about a horizontal axis generally parallel to but spaced from the gun barrel of the firearm. The arm is pivotal between a first, non-sighting position and a second, sighting position spaced from the gun barrel. A peep sighting member is mounted on the arm. The arm can be moved from one of its first and second positions to the other of its first and second positions. Alignment of the peep sighting member relative to the firearm is provided to allow aiming of the firearm by aligning the firearm to have the peep sight and the front sight in line with the target.

It is thus an object of the present invention to provide a novel foldable peep sight.

It is further an object of the present invention to provide such novel foldable peep sight which can be utilized in conjunction with a scope sight.

It is further an object of the present invention to provide such novel foldable peep sight which can be used in conjunction with a scope sight without requiring removal of the scope sight.

It is further an object of the present invention to provide such novel foldable peep sight which is biased to a second, sighting position from a first, non-sighting position.

It is further an object of the present invention to provide such novel foldable peep sight which is of simple construction.

It is further an object of the present invention to provide such novel foldable peep sight which is automatically aligned in a sighting position when the scope sight is moved out of its sighting position.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2, 3, 4, 5:
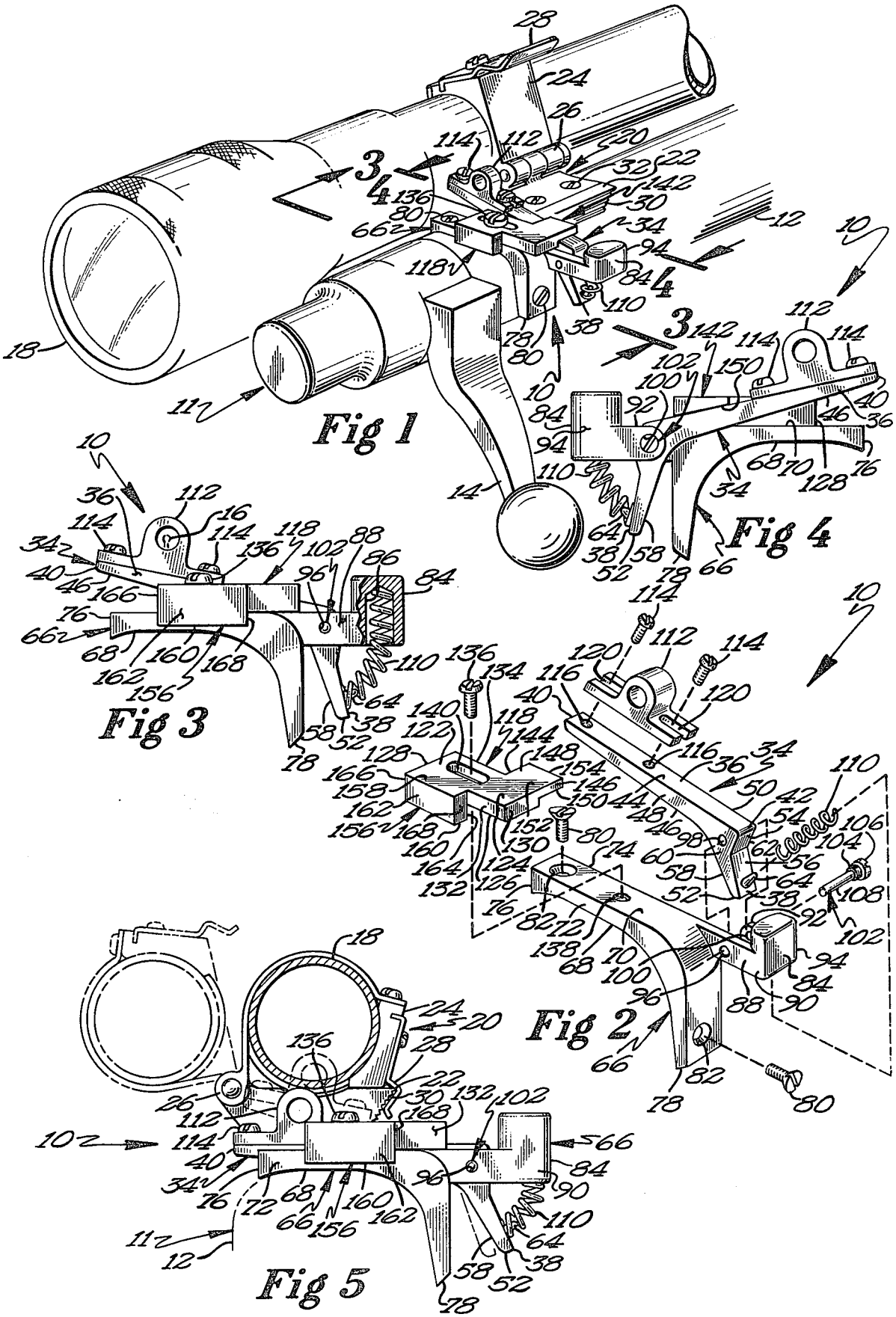
FIG. 1 shows a foldable peep sight according to the teachings of the present invention in use with a firearm having a scope sight, partially shown.
FIG. 2 shows an exploded perspective view of the foldable peep sight of FIG. 1.
FIG. 3 shows an end view of the foldable peep sight of FIG. 1 according to view line 3—3 of FIG. 1.
FIG. 4 shows an end view of the foldable peep sight of FIG. 1 according to view line 4—4 of FIG. 1.
FIG. 5 shows a partial cross sectional view of the foldable peep sight of FIG. 1.

All figures are drawn for ease of explanation of the basic teachings of the present invention only; the extensions of the figures with respect to number, position, relationship, and dimensions of the parts to form the preferred embodment will be explained.

Where used in the various figures of the drawings, the same numerals designate the same or similar parts in the figures. Furthermore, when the terms "horizontal", "vertical", "first", "second", and similar terms are used herein, it should be understood that these terms have reference only to the structure shown in the drawings as it would appear to a person viewing the drawings and are utilized only to facilitate describing the invention.

DESCRIPTION

A foldable peep sight according to the teachings of the present invention is generally shown in the drawings and designated 10. Sight 10 is shown in the preferred embodiment as mounted to a firearm 11 such as a rifle including a barrel 12, a bolt action 14, and a front sight 16. In the preferred form of the present invention, rifle 11 includes a scope sight 18 pivotally mounted to rifle 11 by a scope mount 20. In the preferred embodiment, mount 20 is of the type No. 136 sold by W. R. Weaver Company. Mount 20 includes a first mount member 22 and a second mount member 24 pivotally interconnected thereto about a horizontal axis which is parallel to but spaced from the axis of gun barrel 12 by hinge 26. For releasably interlocking member 22 to member 24, member 24 includes a spring clip 28 which is received in an undercut 30 formed in member 24. Thus, scope sight 18 is pivotal about the horizontal axis defined by hinge 26 from a first, sighting position located on top of barrel 12 of rifle 11 and in line with the target and a second, non-sighting position located to the side of barrel 12 of rifle 11. Mount member 22 has a shape complementary to barrel 12 and can be mounted thereto such as by screws 32 which pass therethrough.

In the preferred form of the present invention, sight 10 includes a generally L-shaped body 34 having an elongated arm 36 and a leg 38. Arm 36 has a first free end 40, a second end 42, a top surface 44, a bottom surface 46, a first side 48 and a second side 50. In the preferred embodiment, arm 36 is in the general shape of a right parallelepiped, and particularly a cross section through surfaces 44 and 46 and sides 48 and 50 is generally rectangular in shape and ends 40 and 42 are generally perpendicular to surfaces 44 and 46 and sides 48 and 50. Leg 38 has a first free end 52, a second end 54, a top surface 56, a bottom surface 58, a first side 60, and a second side 62. End 54 of leg 38 is attached to end 42 of arm 36 at an acute angle. Surface 58 is relatively flat and merges with surface 46 in a rounded and smooth curved manner. Surface 56 is generally angular in shape having a first portion generally parallel to and coextensive with end 42 of arm 36 and a second portion which is generally perpendicular to end 52 and generally parallel to the axis of leg 38. Sides 60 and 62 are generally perpendicular to surfaces 56 and 58 and end 52. A spring keeper 64 is provided on the second portion of surface 56 of leg 38.

Sight 10 further includes in its preferred form of the present invention a peep sight mount 66 for mounting to firearm 11. Mount 66 generally includes bottom and top surfaces 68 and 70, first and second sides 72 and 74, and first and second ends 76 and 78, respectively. Bottom surface 68 has an arcuate shape complementary to and for mounting upon barrel 12 of rifle 11 by suitable fastening members such as screws 80 which extend through apertures 82 formed in mount 66. Top surface 68 is also generally arcuate shaped but includes a generally horizontal portion and a vertical portion.

In the preferred embodiment of the present invention, a spring retainer block 84 having a cylindrical opening 86 is attached to mount 66 by a connecting arm 88. Arm 88 is attached to first side 90 of block 84 and extends to top surface 68 of mount 66 generally parallel to and in line with side 74. A second arm 92 extends from second side 94 of block 84 generally parallel to but spaced from arm 88.

Apertures 96 and 98 are formed in arm 88 and arm 36 of body 34, respectively, and a threaded aperture 100 is formed in arm 92 in the preferred embodiment of the present invention. Sight 10 further includes in the preferred form of the present invention a pivot pin 102 having a threaded shank portion 104 located adjacent head 106 and a non-threaded shank portion 108. Threaded portion 104 can then be threadably secured within aperture 100 of arm 92. Body 34 can then be positioned such that pin 102 extends through apertures 100, 98, and 96 to pivotally mount arm 36 of body 34 about a generally horizontal axis which is generally parallel to but spaced from the axis of gun barrel 12. Arm 36 of body 34 has a first pivotal, non-sighting, storage, transport position adjacent gun barrel 12 as best seen in FIG. 5 and a second pivotal, sighting position spaced from the gun barrel 12 as best seen in phantom in FIG. 5 and in solid in FIGS. 1, 3, and 4.

For moving arm 36 of body 34 from its first position to its second position, a spring 110 is provided in the preferred embodiment of the present invention between leg 38 and block 84 for biasing arm 36 of body 34 to its second position. Spring 110 is retained in position by keeper 64 of body 34 and opening 86 of block 84.

In its preferred form, sight 10 further includes a peep sighting member 112 mounted on arm 36 of body 34 such as by screws 114 which extend into apertures 116 formed in top surface 44 of arm 36.

For aligning peep sighting member 112 relative to mount 66, and thus rifle 11, for alignment with front sight 16 to allow aiming or "sighting in" of firearm 11 to allow the firearm to be aligned to have peep sighting member 112 and front sight 16 in line with the firearm target, member 118 and slotted apertures 120 are provided in the preferred embodiment of the present invention. Specifically, screws 114 extend through apertures 120 formed in peep sighting member 112 such that peep sighting member 112 can be adjustably fixed or positioned at the desired location on top surface 44 of arm 36 of body 34.

Member 118 in the preferred embodiment of the present invention generally includes a slide portion 122 having top and bottom surfaces 124 and 126, first and second ends 128 and 130, and first and second sides 132 and 134, respectively. In its most preferred form, slide portion 122 has the shape of a right parallelepiped and particularly a cross section through surfaces 124 and 126 and sides 132 and 134 is generally rectangular in shape and ends 128 and 130 are perpendicular to surfaces 124 and 126 and sides 132 and 134. Slide portion 122 of member 118 is slidably mounted to mount 66 by a screw 136 threadably received in a threaded aperture 138 formed in the horizontal portion of top surface 68 of mount 66 and extending through an elongated slot 140 formed through surfaces 124 and 126 of member 118.

Member 118 further includes in the preferred embodiment of the present invention an arm abutment portion 142 having first and second ends 144 and 146, top and bottom surfaces 148 and 150, and first and second sides 152 and 154, respectively. In the preferred embodiment, top surface 148 is parallel to and in line with top surface 124 of slide member 122, second end 146 is parallel to and in line with end 130 of slide member 122, and first side 152 is coextensive with and the same as side 134 of sliding member 122. End 144 is parallel to and spaced from end 128 of slide portion 122. Bottom surface 150 is angular in construction for abutting with top surface 44 of arm 36 of body 34 as best seen in FIGS. 1 and 4.

Member 118 in the preferred embodiment of the present invention further includes a positioning member 156 having, in its preferred form, top and bottom surfaces 158 and 160, first and second sides 162 and 164, and first and second ends 166 and 168, respectively. In the preferred embodiment, top surface 158 of member 156 is generally parallel to and in line with top surface 124 of slide portion 122, bottom surface 160 is generally parallel to and spaced below bottom surface 126 of slide portion 122, side 164 is attached to side 132 of slide portion 122, and end 166 is parallel to and in line with end 128 of slide portion 122. Generally, member 156 is perpendicular to slide portion 122. In its most preferred form, member 156 has the shape of a right parallelepiped and particularly, a cross section through surfaces 156 and 158 and sides 162 and 164 is generally rectangular in shape and ends 166 and 168 are generally perpendicular to surfaces 158 and 160 and sides 162 and 164. Side 164 of member 156 abuts and slides against side 72 of mount 66. Therefore, member 156 insures that member 118 maintains a slidable condition with mount 66 such that bottom surface 150 of abutment portion 142 engages with top surface 44 of arm 36 of body 34 along a line or a plane rather than a single point.

It can then be appreciated that peep sight 10 can be "sighted in" by aligning peep sighting member 112 of peep sight 10 relative to mount 66, firearm 11, and front sight 16 by member 118 and slotted apertures 120. Specifically, member 118 can be adjustably fixed on mount 66 by loosening screw 136 sufficient to allow slide portion 122 to slide on the horizontal portion of top surface 70 of mount 66. Since arm abutting member or arm abutment portion 142 is attached to slide portion 122, arm abutment portion 142 can then abut with arm 36 at differing locations and thus control the pivotal movement of arm 36 about pivot pin 102 and consequently to control the pivot location of the second pivotal, sighting position of arm 36. Thus, the position of peep sighting member 112 mounted on arm 36 relative to mount 66, firearm 11, and front sight 16 can be aligned by adjusting the amount arm 36 pivots about the horizontal axis defined by pivot pin 102 under the bias of spring 110.

Likewise, the alignment of peep sighting member 112 relative to mount 66, firearm 11, and front sight 16 can be accomplished by the adjustable mounting of member 112 on arm 36. Specifically, the position of sighting member 112 on arm 36 can be varied by loosening screws 114 and sliding peep sight member 112 relative to arm 36 because of slotted apertures 120 to the desired position, where screws 114 can again be tightened.

Therefore, foldable peep sight 10 can be "sighted in" or aligned with the front sight 16 such that firearm 11 can be aimed by aligning firearm 11 to have peep sighting member 112 of peep sight 10 and front sight 16 in line with the firearm target.

As best seen in FIG. 5, according to the teachings of the present invention scope sight 18 and mount 20 can be arranged with respect to peep sight 10 such that when scope sight 18 is located in its first, sighting position, the scope sight abuts with peep sighting member 112 for moving and holding peep sight 10 in its first, non-sighting position as best seen in solid in FIG. 3 and when scope sight 18 is in its second, non-sighting position as shown in phantom in FIG. 5 and in solid in FIG. 1, scope sight 18 is spaced from and does not abut with peep sighting member 112 of peep sight 110 allowing arm 36 to move and be held in its second, sighting position by spring 110 as best seen in phantom in FIG. 5 and in solid in FIGS. 1, 3, and 4. Specifically, in its preferred form, the horizontal axis defined by hinge 26 of the pivotal scope sight mount 20 is parallel to but spaced from gun barrel 12 and located on opposite sides of firearm 11 than the horizontal axis of arm 36 defined by pivot pin 102. Further, in the preferred form, the horizontal axes defined by hinge 26 and pivot pin 102 are parallel but spaced from each other.

It can then be appreciated that after peep sighting member 112 and peep sight 10 have been aligned as set forth hereinbefore for the preferred embodiment of the present invention, with scope sight 18 in its first, sighting position, scope sight 18 abuts against and holds peep sighting member 112 of peep sight 10 in its first, non-sighting, storage position. However, when it is desired to utilize peep sight 10 rather than scope sight 18, it is only necessary to pivot scope sight 18 to its second, non-sighting position and peep sight 10 will automatically pivot to its second, sighting position under bias of spring 110. It should then be noted that peep sight 10 is in alignment with front sight 16 without the need of any further adjustment. When it is again desired to use scope sight 18 rather than peep sight 10, scope sight 18 is simply pivoted to its first, sighting position where scope sight 18 abuts with peep sighting member 112 of peep sight 10 to automatically pivot arm 36 to its first, non-sighting position.

Now that the basic teachings of the present invention have been explained, many extensions and variations will be obvious to one having ordinary skill in the art. For example, although foldable peep sight 10 is shown in use with scope sight 18 and scope mount 20, it can be appreciated that peep sight 10 can be utilized without scope sight 18 or with similar sights and/or with different types of sight mounts than the ones utilized in the preferred embodiment of the present invention.

Also, it should be noted that first mount member 22 of scope sight mount 20 can be manufactured with mount 66 as as a unitary member according to the teachings of the present invention, if desired.

Additionally, although foldable peep sight 10 is shown in the preferred embodiment as utilized with a rifle 11, peep sight 10 can be utilized with other types and constructions of firearms and the like where alignment of an article is accomplished by aligning three points in a line.

Although in the preferred embodiment peep sight 10 moved by spring 110 and scope sight 18 has been found to be particularly advantageous, peep sight 10 according to the teachings of the present invention can be utilized without scope sight 18 where arm 36 can be moved between its first and second positions by other means than scope sight 18 and/or biasing by spring 110 or can be moved by other means than spring 110 in the manner shown in the preferred embodiment.

Likewise, the alignment of peep sighting member 112 and peep sight 10 can be accomplished by other methods than member 118 and slotted apertures 120. However, member 118 and slotted apertures 120 are preferred because of the advantages obtained by their synergistic combination.

Likewise, since arm 36 is at an angle, when peep sighting member 112 is aligned by moving it on arm 36 by elongated apertures 120, peep sighting member 112 will move both horizontally and vertically relative to mount 66, firearm 11, and front sight 16. In a similar manner, since arm 36 travels along an arc, when peep sighting member 112 is aligned utilizing member 118 peep sighting member 112 will move both horizontally and vertically relative to mount 66, firearm 11, and front sight 16. Alignment can then be performed in different manners such that alignment can occur separately along pure horizontal and vertical axes. For example, arm 36 could be formed of two pieces pivotally interconnected such that sighting member 112 is located in a horizontal position at all times no matter what the angular position of arm 36. However, member 118 and 120 is the preferred form because of the advantages set forth hereinbefore.

It can then be appreciated that peep sight 10 according to the teachings of the present invention has few moving parts, can be easily manufactured and assembled, maximizes the material used, is not prone to damage when utilized in the field with firearm 11, and is reliable. Thus, the shapes and construction of the various components of the present invention result in a synergistic combination which makes peep sight 10 according to the preferred teachings of the present invention clearly advantageous.

Thus, since the invention disclosed herein may be embodied in other specific forms without departing from the spirit or the general characteristics thereof, some of which forms have been indicated, the embodiment described herein is to be considered in all respects illustrative and not restrictive. The scope of the invention is indicated by the appended claims, rather than by the foregoing description and all changes which come within the meaning and range of equivalency of the claims are intended to be embraced therein.

What is claimed is:

1. Foldable peep sight for use with a firearm having a gun barrel and a front sight comprising, in combination: a generally L-shaped body, with the L-shaped body including an elongaged arm having a first free end and a second end and a leg having a first free end and a second end, with the second ends of the arm and the leg being interconnected; a mount for attachment to the firearm; a pivot pin threadably engaged in the mount and extending through the arm of the L-shaped body for pivotally mounting the body about a horizontal axis generally parallel to but spaced from the gun barrel, with the arm of the body having a first pivotal, non-sighting position adjacent the gun barrel and a second pivotal, sighting position spaced from the gun barrel;

means for biasing the arm to its second pivotal position comprising a spring extending between the first end of the leg of the body and the mount; elongated slots formed in the peep sighting member; members threadably engaged in the arm of the body which extend through the elongated slots of the peep sighting member for allowing the variable positioning of the peep sighting member on the arm of the body; an arm abutting member; means for positioning the arm abutting member to abut with the arm to limit the amount the arm pivots about the horizontal axis under the bias of the spring, with the elongated slots and the arm abutting member allowing the alignment of the peep sight relative to the mount for alignment with the front sight to allow aiming of the firearm by aligning the firearm to have the peep sight and the front sight in line with the target; a scope sight; means for pivotally mounting the scope sight to the firearm from a first, sighting position to a second, non-sighting position, with the scope sight abutting with the peep sighting member in its first, sighting position to move the foldable peep sight from its second, sighting position against the bias of the spring to its first, non-sighting position, and with the second position of the scope sight being in a non-abutting, spaced relation from the peep sighting member allowing the arm to move from its first, non-sighting position to its second, sighting position under the bias of the spring.

2. The foldable peep sight of claim 1 wherein the mount includes a top surface, a bottom surface and at least one side, with the bottom surface having an arcuate shape complementary to and for receipt onto the barrel of the firearm, with the top surface of the mount including a generally horizontal portion, and wherein the arm abutting member positioning means comprises means for slidably mounting the arm abutting member to the mount comprising, in combination: a slide portion; means for slidably mounting the slide portion on the horizontal portion of the top surface of the mount; a slide positioning member attached to the slide portion for slidable movement along the side of the mount, with the arm abutting member being attached to the slide portion.

3. The foldable peep sight of claim 2 wherein the slide portion has the shape of a right parallelepiped having a top surface, a bottom surface, a first end, a second end, a first side and a second side, with the slide positioning member having the shape of a right parallelepiped having a top surface, a bottom surface, a first end, a second end, a first side, and a second side, with the second side of the slide positioning member being attached to the first side of the slide portion and extending below the bottom surface of the slide portion for slidably abutting with the side of the mount, and with the arm abutting member being attached to the second side of the slide portion and including an angled bottom surface for abutting with the arm at least along a line.

4. Foldable peep sight for use with a firearm having a gun barrel and a front sight comprising, in combination: an arm; means for pivotally mounting the arm about a horizontal axis generally parallel to but spaced from the gun barrel, with the arm having a first pivotal, non-sighting, storage position and a second pivotal position spaced from the gun barrel in a sighting relation with the front sight of the firearm; a peep sighting member mounted on the arm; means for moving the arm between its first and second positions; means for aligning the peep sighting member with the front sight to allow aiming of the firearm by aligning the firearm to have the peep sight and the front sight in line with the target; and wherein the means for moving the arm includes means for biasing the arm from one of its first and second positions to the other of its first and second positions.

5. The foldable peep sight of claim 4 wherein the biasing means comprises, in combination: a leg having a first end attached to the arm and a second free end; a spring having a first end operatively attached to the second end of the leg and a second end held in a stationary position relative to the firearm.

6. The foldable peep sight of claim 5 wherein the pivotally mounting means includes a spring retainer block, with the second end of the spring being held in a relatively stationary position with respect to the firearm by the spring retainer block.

7. The foldable peep sight of claim 4 wherein the peep sighting member is mounted on the arm by screws threadably received into the arm, and wherein the aligning means includes elongated slots formed in the peep sighting member, with the screws which mount the peep sighting member to the arm extending through the elongated slots of the peep sighting member to allow the variable fixed positioning of the peep sighting member on the arm.

8. The foldable peep sight of claim 4 or 8 wherein the aligning means includes means for abutting with the arm to variably fix the second pivotal position of the arm.

9. Foldable peep sight for use with a firearm having a gun barrel and a front sight comprising, in combination: an arm; means for pivotally mounting the arm about a horizontal axis generally parallel to but spaced from the gun barrel, with the arm having a first pivotal, non-sighting, storage position and a second pivotal position spaced from the gun barrel in a sighting relation with the front sight of the firearm; a peep sighting member mounted on the arm; means for moving the arm between its first and second positions; means for aligning the peep sighting member with the front sight to allow aiming of the firearm by aligning the firearm to have the peep sight and the front sight in line with the target including means for abutting with the arm to variably fix the second pivotal position of the arm comprising, in combination: an arm abutting member having a bottom surface; and means for variably positioning the arm abutting member relative to the pivotally mounting means.

10. The foldable peep sight of claim 9 wherein the pivotally mounting means comprises a mount for attachment to the firearm including a top surface, a bottom surface, and at least one side, with the top surface of the mount including a generally horizontal portion, and wherein the arm abutting member positioning means comprises means for slidably mounting the arm abutting member to the mount comprising, in combination: a slide portion; means for slidably mounting the slide portion on the horizontal portion of the top surface of the mount; a slide positioning member attached to the slide portion for slidable movement along the side of the mount, with the arm abutting member being attached to the slide portion.

11. Foldable peep sight for use with a firearm having a gun barrel and a front sight comprising, in combination: an arm; means for pivotally mounting the arm about a horizontal axis generally parallel to but spaced from the gun barrel, with the arm having a first pivotal, non-sighting, storage position and a second pivotal position spaced from the gun barrel in a sighting relation with the front sight of the firearm; a peep sighting member mounting on the arm; means for moving the arm between its first and second positions; means for aligning the peep sighting member with the front sight to allow aiming of the firearm by aligning the firearm to have the peep sight and the front sight in line with the target; and wherein the arm moving means moves the arm from its first, nonsighting position to its second, sighting position, and wherein the foldable peep sight further comprises, in combination: a scope sight; means for mounting the scope sight to the firearm for movement between a first, sighting position and a second, nonsighting position, with the scope sight abutting with the peep sighting member in its first, sighting position to move the foldable peep sight from its second, sighting position against the arm moving means to its first, nonsighting position, and with the second position of the scope sight being in a nonabutting, spaced relation from the peep sighting member allowing the arm to move from its first, nonsighting position to its second, sighting position by the moving means.

12. The foldable peep sight of claim 11 wherein the scope sight mounting means pivotally mounts the scope sight about a horizontal axis which is generally parallel to the gun barrel, and wherein the horizontal axis of the pivotally mounting means is parallel to and spaced from the horizontal axis of the scope sight mounting means, with the horizontal axis of the pivotally mounting means being located on generally the opposite side of the firearm than the horizontal axis of the scope sighting means.

* * * * *